United States Patent [19]

Gager

[11] 4,008,530

[45] Feb. 22, 1977

[54] INFLATABLE SOLE SHOE

[75] Inventor: Dennis J. Gager, Medford, N.J.

[73] Assignee: The Raymond Lee Organization, Inc., New York, N.Y. ; a part interest

[22] Filed: Jan. 5, 1976

[21] Appl. No.: 646,614

[52] U.S. Cl. ..... 36/28

[51] Int. Cl.[2] ..... A43B 13/18

[58] Field of Search ..... 36/28, 29, 35 R, 35 B

[56] References Cited

UNITED STATES PATENTS

| | | | |
|---|---|---|---|
| 1,056,426 | 3/1913 | Kenny | 36/29 |
| 2,605,560 | 8/1952 | Gouabault | 36/29 |
| 3,765,422 | 10/1973 | Smith | 36/28 |
| 3,834,046 | 9/1974 | Fowler | 36/28 |

*Primary Examiner*—Patrick D. Lawson
*Attorney, Agent, or Firm*—Howard I. Podell

[57] ABSTRACT

A shoe formed with an inflatable sole adaptable for filling with a fluid under pressure. The inflatable sole section extends from the front to the rear of the shoe and is fitted on the side with a flush mounted valve for inflating or deflating the sole. An alternate embodiment employs an inflatable inner sole shaped for orthopedic purposes mounted between the bottom of the shoe and a shaped inflatable outer sole.

1 Claim, 3 Drawing Figures

INFLATABLE SOLE SHOE

SUMMARY OF THE INVENTION

My invention is a shoe formed with an inflatable sole adaptable for filling with a fluid under pressure. The inflatable sole section extends from the front to the rear of the shoe and is fitted on the side with a flush mounted valve for inflating or deflating the sole. An alternate embodiment employs an inflatable inner sole shaped for orthopedic purposes mounted between the bottom of the shoe and a shaped inflatable outer sole.

BRIEF DESCRIPTION OF THE DRAWINGS

The objects and features of the invention may be understood with reference to the following detailed description of an illustrative embodiment of the invention, taken together with the accompanying drawings in which.

Figure 1:
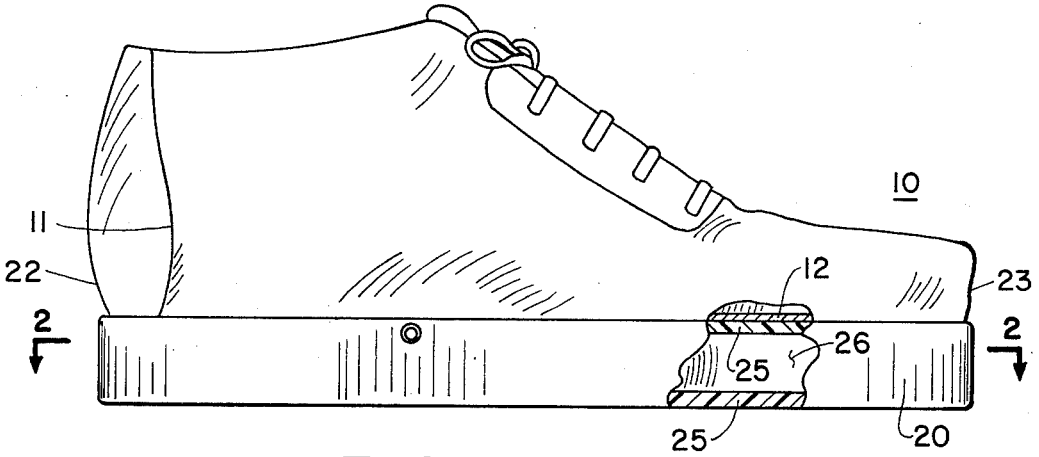
FIG. 1 is a side view of the invention.
Figure 2:
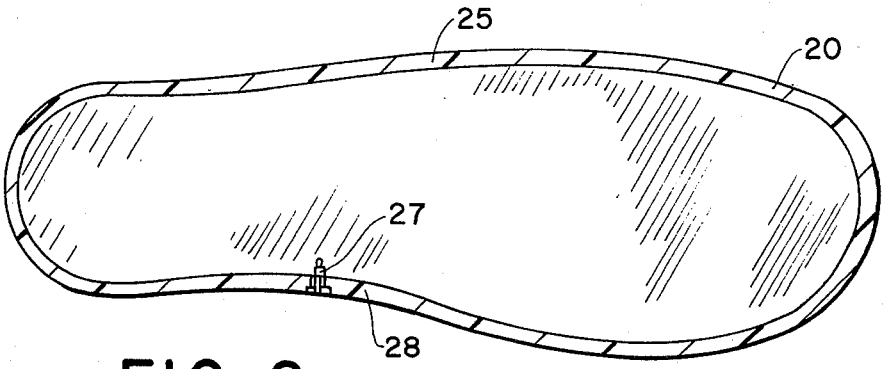
FIG. 2 is a plan sectional view of the sole, taken along line II—II of FIG. 1.

DESCRIPTION OF THE PREFERRED EMBODIMENT:

Turning now descriptively to the drawings, in which similar reference characters denote similar elements throughout the several views, FIGS. 1–2 illustrate the shoe 10 which is formed of a conventional shoe top shape 11, the upper sole 12 of which is mounted on an inflatable sole until 20 extending from the rear end 22 of the shoe to the toe end 23.

Inflatable sole 20 is formed of a semi-flexible plastic or rubber wall 25 which encloses in a sealed manner an internal chamber 26. A valve 27 is flush mounted to the side 28 of the sole 20 to permit inflation under pressure of a fluid such as air, water or other liquid.

When so inflated, the shoe 10 conveys a sense of comfort and springiness to the wearer which reduces fatigue.

Figure 3:
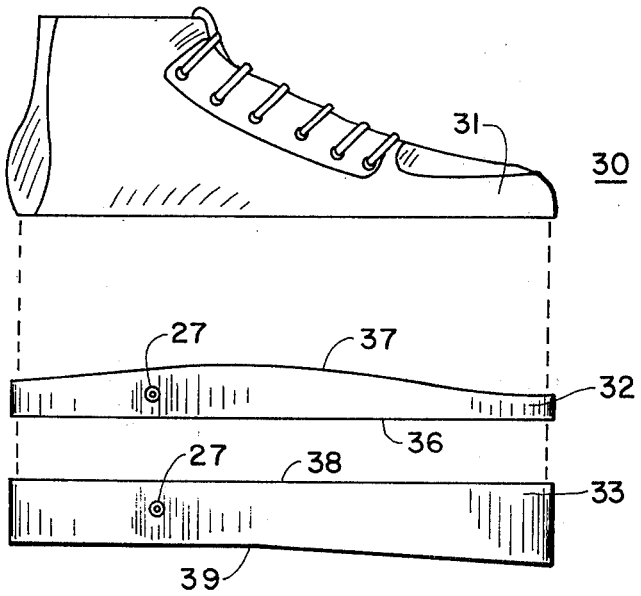
FIG. 3 is an exploded side view of an alternate embodiment of the invention.

FIG. 3 illustrates an alternate embodiment, shoe 30 for orthopedic purposes.

Shoe 30 is formed with a conventional top section 31 mounted to a shaped inflatable upper section 32 that in turn is mounted on a shaped lower inflatable section 33, with both inflatable sections 32 and 33 individually fitted with valves 27.

Upper sole section 32 is shaped so that when inflated, the lower surface 36 is flat and the upper surface 37 is formed as a convex arcuate surface extending along the longitudinal axis of the sole 32.

Lower section 33 is shaped with a flat upper surface 38 and a lower surface 39 that is a greater height at the forward section of the sole 33 than the rear section.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. An orthopedic inflatable shoe, formed with a first inflatable sole section and a second inflatable inner sole section, with each of said sole sections individually fitted with valves for independent inflation of each said section by a fluid under pressure, each said inflatable section formed of a top wall, and a bottom wall joined continuously together by a side wall, with the first inflatable sole section shaped so that in the inflated condition, the upper wall is generally flat and the bottom wall extends from the said upper wall by a greater distance at the front portion of the sole section than at the rear portion of the sole section, and with the second inflatable section shaped so that in the inflated condition, the bottom wall is generally flat and the top wall is formed as a convex arcuate surface extending along the longitudinal axis of the said second sole.

* * * * *